United States Patent [19]

Schranz et al.

[11] Patent Number: 4,689,286

[45] Date of Patent: Aug. 25, 1987

[54] COLOR PHOTOGRAPHIC RECORDING MATERIAL DEVELOPABLE BY HEAT TREATMENT

[75] Inventors: Karl-Wilhelm Schranz, Odenthal-Hahnenberg; Günther Schenk, Cologne; Hans Öhlschläger, Bergisch Gladbach, all of Fed. Rep. of Germany

[73] Assignee: Agfa Gevaert Aktiengesellschaft, Leverkusen, Fed. Rep. of Germany

[21] Appl. No.: 848,650

[22] Filed: Apr. 7, 1986

[30] Foreign Application Priority Data

Apr. 19, 1985 [DE] Fed. Rep. of Germany ..... 3514186

[51] Int. Cl.[4] ..... G03C 1/34

[52] U.S. Cl. ..... 430/138; 430/617; 430/619; 430/620; 430/203; 430/551; 430/559; 430/562; 430/607; 430/611; 430/600; 430/603; 430/351; 430/353; 430/505

[58] Field of Search ..... 430/617, 619, 620, 203, 430/505, 560, 351, 551, 611, 607, 559, 562, 138, 600, 603, 353

[56] References Cited

U.S. PATENT DOCUMENTS

| | | | |
|---|---|---|---|
| 3,051,570 | 8/1962 | Dersch et al. | 430/607 |
| 4,463,082 | 7/1984 | Ferguson et al. | 430/611 |
| 4,614,702 | 9/1986 | Sawada et al. | 430/611 |

*Primary Examiner*—Won H. Louie

*Attorney, Agent, or Firm*—Connolly and Hutz

[57] ABSTRACT

A color photographic recording material developable by heat treatment and comprising at least one binder layer, which contains photosensitive silver halide, optionally a substantially non-photosensitive silver salt and a color providing compound (dye releaser), can be improved in regard to the Dmin/max relation and in regard to sensitivity by addition of a compound corresponding to formula I $$R^1—S—CO—O—R^2$$

in which $R^1$ and $R^2$ independently of one another represent alkyl, alkenyl, cycloalkyl, aralkyl or aryl.

9 Claims, No Drawings

COLOR PHOTOGRAPHIC RECORDING MATERIAL DEVELOPABLE BY HEAT TREATMENT

This invention relates to a color photographic recording material developable by heat treatment and comprising at least one binder layer which is applied to a layer support and which contains photosensitive silver halide and a non-diffusing color-providing compound, the recording material also containing a fog-reducing compound.

It is known that colored images can be produced by heat treatment of suitable color photographic recording materials. Color-providing compounds particularly suitable for this purpose are those which may be incorporated in non-diffusing form in the layer of a photographic recording material and which is capable of releasing a diffusible dye in consequence of development (dye releaser). The particular suitability of dye releasers of the type in question is based on the fact that the dyes released imagewise can be transferred to special image-receiving layers to form a brilliant dye image which is not masked by troublesome image silver or silver halide and, accordingly, does not require any aftertreatment. Accordingly, the combination of the heat development process with the dye diffusion process gives an advantageous rapid process for the production of colored images. A recording material suitable for this purpose is described, for example, in DE-A-32 15 485.

According to this publication, a recording material comprising a layer containing a combination of silver halide, silver benzotriazole, a dye releaser and guanidine trichloroacetate (base donor) is exposed imagewise and then transferred in contact with an image-receiving sheet. The production of multicolored images requires several such combinations, the silver halide in each of these combinations being sensitive to another spectral region and—commensurate with its spectral sensitivity—containing an associated dye releaser which releases a dye of another color, usually a dye which is complementary to the color of the light to which the silver halide in question is predominantly sensitive. Associations such as these may be arranged one above the other in various layers.

The color images obtained with the known color photographic recording material developable by heat treatment show fairly low maximum color densities and high fog levels. To overcome this disadvantage, it is proposed in DE-A-33 45 023 to use certain mercapto compounds as fog-reducing agents. However, the color images obtained using these mercapto compounds are not entirely satisfactory in regard to the Dmin/Dmax relation or in regard to sensitivity.

Accordingly, the object of the present invention is to provide a color photographic recording material developable by heat treatment which shows a further improvement in regard to the Dmin/Dmax relation and in regard to sensitivity.

The present invention relates to a photographic recording material developable by heat treatment and comprising at least one binder layer which is applied to a layer support and which contains photosensitive silver halide, optionally a substantially non-photosensitive silver salt, at least one non-diffusing color-providing compound, which is capable of releasing a diffusible dye in consequence of the development by heat treatment, and a fog-reducing compound, characterized in that the fog-reducing compound corresponds to the following general formula $$R^1—S—CO—O—R^2 \qquad \text{I}$$

in which $R^1$ and $R^2$ may be the same or different and each represent an alkyl, alkenyl, cycloalkyl, aralkyl or aryl group.

Each of the groups mentioned may be unsubstituted or substituted, for example by one or more halogen atoms and/or by one or more of the following groups: hydroxy, alkoxy, aroxy, acyloxy, amino, acylamino, alkyl, alkoxycarbonyl, carbamoyl, alkylsulfonyl, sulfamoyl and heterocyclic groups.

Whereas the group represented by $R^1$ preferably has a molecular weight of at least 100 and, more preferably, a molecular weight of at least 200, the group represented by $R^2$ has virtually no limitation in this respect. Preferred examples of the group represented by $R^1$ are alkyl groups containing more than 8 carbon atoms; alkyl groups containing up to 4 carbon atoms substituted by alkoxy, aroxy, amino, alkoxycarbonyl, carbamoyl or alkylsulfonyl; and in particular aryl groups substituted by halogen, alkoxy, acylamino, alkyl, alkoxycarbonyl, carbamoyl and/or sulfamoyl. Examples of the group represented by $R^2$ are, in particular, alkyl, cycloalkyl and aryl containing up to 10 carbon atoms, for example methyl, ethyl, n-propyl, isopropyl, n-butyl, s-butyl, cyclohexyl, 4-t-butylcyclohexyl and phenyl. The group represented by $R^2$ may even be a polyfunctional, more especially difunctional, organic group to which correspondingly several, more especially two, groups of the formula $R^1$—S—CO—O— are attached to give a compound corresponding to formula I. The following are examples of these difunctional groups represented by $R^2$:

$$—CH_2—CH_2—$$

$$—CH_2—CH_2—CH_2—CH_2—$$

$$—CH_2—CH_2—O—CH_2—CH_2—$$

$$—(CH_2)_6—$$

The following are examples of the fog-reducing compounds according to the invention:

1. $(C_2H_5O—CO—CH_2—S—CO—O)_2—(CH_2)_2—O—(CH_2)_2—$

2. 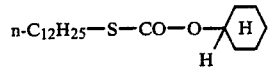

3. $n\text{-}C_{16}H_{33}—S—CO—O—i\text{-}C_3H_7$

4. 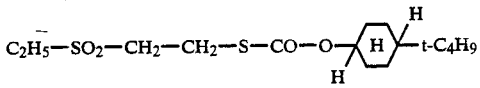

5. $C_6H_{13}—O—C_2H_4—S—CO—O—C_2H_5$

6. 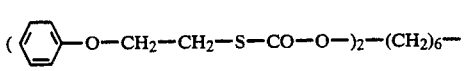

7. 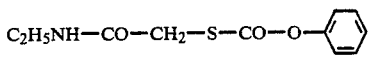

-continued
8. $(n\text{-}C_{18}H_{37})_2N-(CH_2)_3-S-CO-O-CH_3$
9.
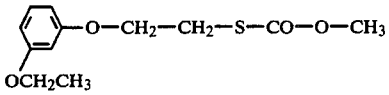
10.
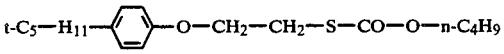
11.
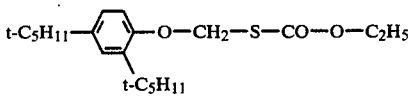
12.
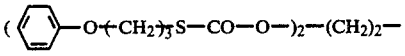
13.
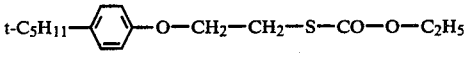
14.
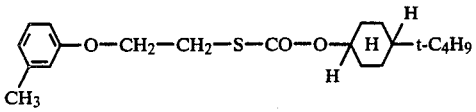
15.
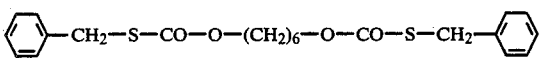
16.
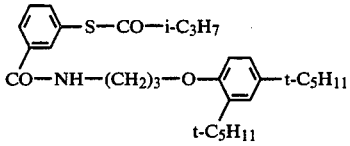
17.
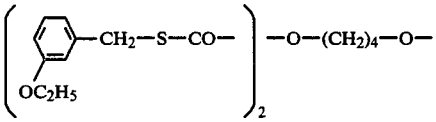
18.
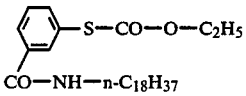
19.
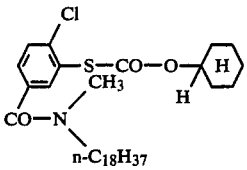
20.
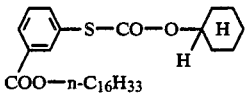
21.
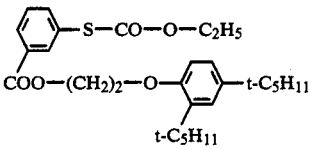
-continued
22.
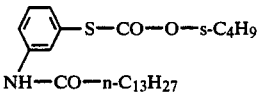
23.
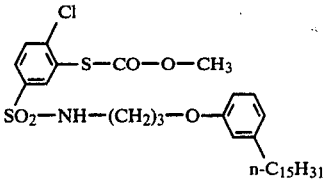
24.
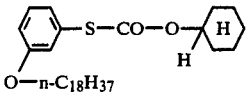
25.
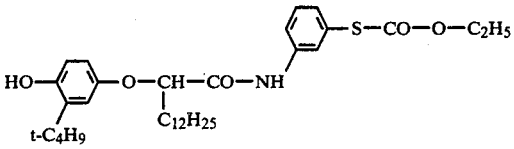
26.
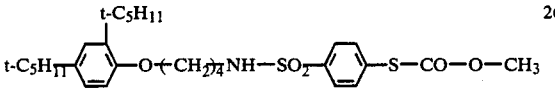
27.
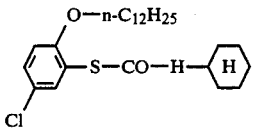
28.
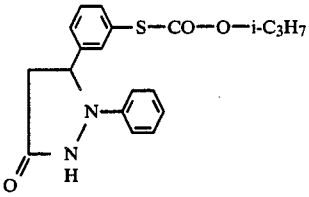
29.
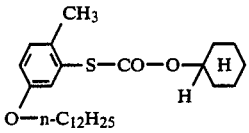
30.
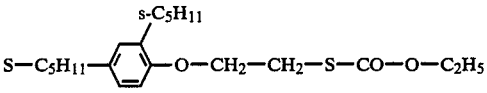
31.
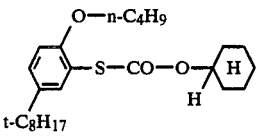
32.
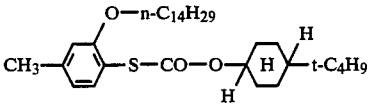

-continued

33.

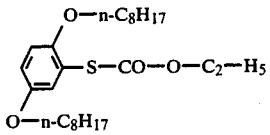

34.

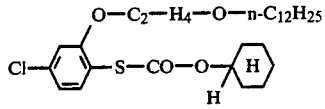

35.

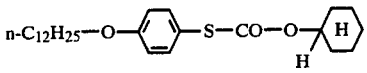

36.

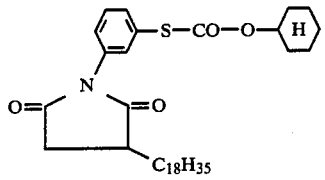

Accordingly, the fog-reducing compounds used in accordance with the invention are monothiocarbonic acid esters. They may be prepared in known manner by reaction of a mercaptan having the formula $R^1$—SH with a chlorocarbonic acid ester having the formula Cl—CO—O—$R^2$. The production process is illustrated by the following synthesis procedure:

Preparation of compound 31

88.3 g of 2-butoxy-5-t-octylthiophenol were dissolved under nitrogen at 10° C. in 1000 ml of acetone with addition of a solution of 12 g of NaOH in 60 ml of distilled water. A solution of 49.5 ml of chloroformic acid cyclohexylester in 150 ml of acetone was added dropwise with stirring over a period of 1 h at 0° to 5° C. to the solution clarified with active carbon (pH 8–9). After stirring for 4 hours at room temperature, the reaction mixture had a pH of 5.0. The sodium chloride precipitated was filtered off under suction and the yellowish filtrate was concentrated to dryness under reduced pressure, stirred once with 150 ml of methanol, filtered under suction, then left standing overnight in a refrigerator with 150 ml of methanol, filtered under suction again and stirred once more for 2 h with 300 ml of methanol. The white product was then dried at room temperature in a vacuum drying cabinet.

Yield: 115.4 g =91.5% of the theoretical

M.p. 53°–54° C.

The fog-reducing compounds used in accordance with the invention were added to the casting solutions for the photosensitive layers. The quantity used may be varied within wide limits and the suitable concentration may readily be determined by the expert by simple routine tests. The fog-reducing compounds are preferably used in a quantity of from 0.01 to 0.5 mole per mole of silver salt. They are best added in the form of a solution in a water-miscible solvent, such as methanol, ethanol, dimethylformamide. Other suitable solvents are ethylacetate and diethylcarbonate.

The color photographic recording material according to the invention contains on a dimensionally stable layer support at least one binder layer containing a photosensitive silver halide, optionally in combination with a substantially non-photosensitive silver salt, a non-diffusing color-providing compound capable of forming a diffusible dye by thermal development and one or more fog-reducing compounds according to the invention.

Accordingly, an essential constituent of the heat-developable recording material according to the invention is the silver halide which may consist of silver chloride, silver bromide, silver iodide or mixtures thereof and which has a particle size of from 0.02 to 2.0 μm and preferably from 0.1 to 1.0 μm. It may be present as non-sensitized silver halide or may even be chemically sensitized by suitable additives and/or spectrally sensitized.

The photosensitive silver halide may be present in the particular layer in a quantity of from 0.01 to 2.0 g/m$^2$, the actual quantity in which the silver halide is used—on account of its catalytic function (as exposed silver halide)—being primarily in the lower part of the above-mentioned range in some embodiments.

The substantially non-photosensitive silver salt may be, for example, a silver salt which is comparatively stable to light, for example an organic silver salt. Suitable examples of such silver salts are the silver salts of aliphatic or aromatic carboxylic acids, the silver salts of nitrogen-containing heterocycles and also silver salts of organic mercapto compounds.

Preferred examples of silver salts of aliphatic carboxylic acids are silver behenate, silver stearate, silver oleate, silver laurate, silver caprate, silver myristate, silver palmitate, silver maleate, silver fumarate, silver tartrate, silver furoate, silver linolate, silver adipate, silver sebacate, silver succinate, silver acetate or silver butyrate. The carboxylic acids on which these silver salts are based may be substituted, for example, by halogen atoms, hydroxyl groups or thioether groups.

Examples of silver salts of aromatic carboxylic acids and other compounds containing carboxyl groups are silver benzoate, silver-3,5-dihydroxybenzoate, silver-o-methylbenzoate, silver-m-methylbenzoate, silver-p-methylbenzoate, silver-2,4-dichlorobenzoate, silver acetamidobenzoate, silver gallate, silver tannate, silver phthalate, silver terephthalate, silver salicylate, silver phenylacetate, silver pyromellitate, silver salts of 3-carboxymethyl-4-methyl-4-thiazoline-2-thione or similar heterocyclic compounds. Also suitable are silver salts of organic mercaptans, for example the silver salts of 3-mercapto-4-phenyl-1,2,4-triazole, 2-mercaptobenzimidazole, 2-mercaptobenzothiazole, 2-mercaptobenzoxazole, 2-mercaptooxadiazole, mercaptotriazine, thioglycolic acid, and also the silver salts of dithiocarboxylic acids, such as for example the silver salt of dithioacetate.

The silver salts of compounds containing an imino group are also suitable. Preferred examples of silver salts such as these are the silver salts of benzotriazole and derivatives thereof, for example silver salts of alkyl- and/or halogen-substituted benzotriazoles, such as for example the silver salts of methylbenzotriazole, 5-chlorobenzotriazole, and also the silver salts of 1,2,4-triazole, 1-H-tetrazole, carbazole, saccharin and silver salts of imidazole and derivatives thereof.

The quantity in which the substantially non-photosensitive silver salt is applied in the particular layer in accordance with the invention is between 0.05 and 5 g/m$^2$. The substantially non-photosensitive silver salt and the photosensitive silver halide may be present alongside one another as separate particles or even in a combined form which may be produced, for example, by treating a substantially non-photosensitive silver salt in the presence of halide ions, photosensitive centers of photosensitive silver halide being formed on the surface of the particles of the substantially non-photosensitive silver salt by double reaction (conversion). Reference is made in this connection to U.S. Pat. No. 3,457,075.

The substantially non-photosensitive silver salt serves as a reservoir for metal ions which are reduced to elemental silver during the thermal development in the presence of a reducing agent under the catalytic effect of the silver halide exposed imagewise and which themselves serve as oxidizing agent (for the reducing agent present).

Another essential constituent of the recording material according to the invention is a non-diffusing color-providing compound which is capable of releasing a diffusible dye in consequence of a redox reaction taking place during development and which is referred to hereinafter as a dye releaser.

The dye releaser used in accordance with the invention are various types of compounds all distinguished by a bond which is redox-dependent in its bonding strength and which attaches a dye residue to a carrier residue containing a ballast group.

In this connection, reference is made to a comprehensive account of the subject in question in Angew. Chem. Int. Ed. Engl. 22 (1983), 191-209, in which the most important of the known systems are described.

Redox-active dye releasers corresponding to the following formula have proved to be particularly advantageous:

BALLAST—REDOX—DYE in which

BALLAST is a ballast group,

REDOX is a redox-active group, i.e. a group which is oxidizable or reducible under the alkaline development conditions and which is subjected to a varying extent—depending on whether it is present in oxidized or reduced form to an elimination reaction, a nucleophilic displacement reaction, a hydrolysis or other splitting reaction, with the result that the DYE residue is split off and DYE is the residue of a diffusible dye, for example a yellow, magenta or cyan dye, or the residue of a dye precursor.

Ballast groups may be regarded as groups which enable the dye donors according to the invention to be incorporated in non-diffusing form in the hydrophilic colloids normally used for photographic materials. Suitable groups of the type in question are, preferably, organic groups which generally contain straight-chain or branched aliphatic groups generally containing from 8 to 20 carbon atoms and, optionally, carbocyclic or heterocyclic, optionally aromatic groups. These groups are attached to the remainder of the molecule either directly or indirectly, for example by one of the following groups: —NHCO—, $NHSO_2$—, —NR—, where R is hydrogen or alkyl, —O— or —S—. In addition, the ballast group may also contain water-solubilizing groups, such as for example sulfo groups or carboxyl groups, which may be present in anionic form. Since the diffusion properties depend on the size of the molecule of the overall compound used, it is even sufficient in certain cases, for example if the overall molecule used is large enough, to use relatively short-chain groups as ballast groups.

Redox-active carrier residues having the structure BALLAST—REDOX—and corresponding dye donors are known in various different forms. There is no need here to provide a detailed account in view of the above-mentioned synoptic article in Angew. Chem. Int. Ed. Engl. 22 (1983), 191-209.

Some examples of redox-active carrier groups, from which a dye residue is split off commensurate with imagewise oxidation or reduction, are given in the following purely by way of illustration:

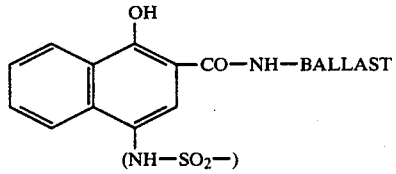

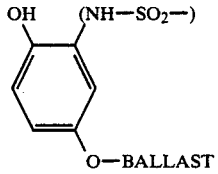

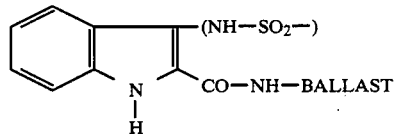

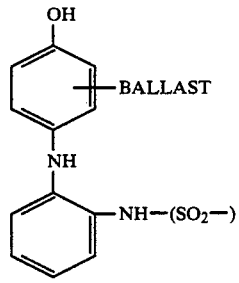

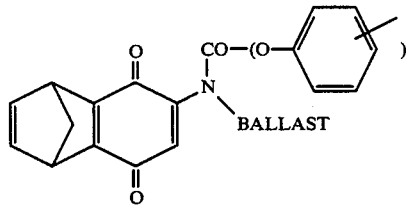

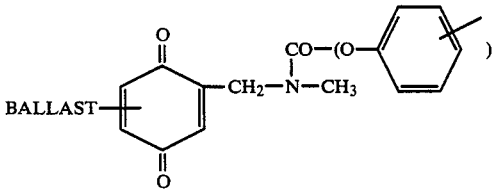

-continued

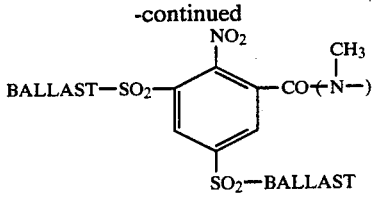

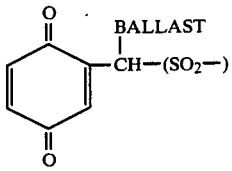

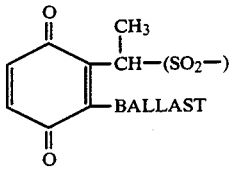

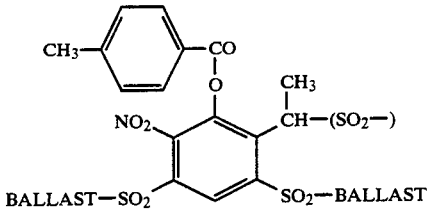

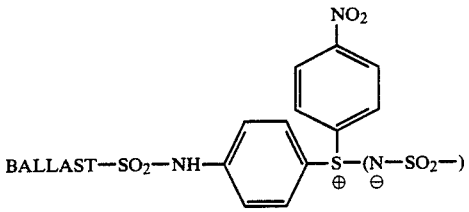

The groups shown in brackets are functional groups of the dye residue and are separated together with the dye residue from the remaining part of the carrier group. The functional group may be a substituent which can have a direct effect upon the absorption and, optionally, complexing properties of the dye released. On the other hand, however, the functional group may even be separated from the chromophore of the dye by an intermediate member or bond. Finally, the functional group may even be of significance, optionally together with the intermediate member, to the diffusion and mordanting behavior of the dye released. Suitable intermediate members, are, for example, alkylene or aryl groups.

In principle, suitable dye residues are the residues of dyes of any class providing they are sufficiently diffusible to be able to diffuse from the photosensitive layer of the photosensitive material into an image-receiving layer. To this end, the dye residues may be provided with one or more alkali-solubilizing groups. Suitable alkali-solubilizing groups are inter alia carboxyl groups, sulfo groups, sulfonamide groups and also aromatic hydroxyl groups. Alkali-solubilizing groups such as these may be preformed in the dye releasers used in accordance with the invention or may emanate from the elimination of the dye residue from the carrier residue carrying ballast groups. Examples of dyes which are particularly suitable for the process according to the invention are azo dyes, azomethine dyes, anthraquinone dyes, phthalocyanine dyes, indigoid dyes, triphenylmethane dyes, including dyes of the type which are or may be complexed with metal ions.

Residues of dye precursors are understood to be the residues of compounds which are converted into dyes during photographic processing, particularly under the thermal development conditions, whether by oxidation, by coupling, by complexing or by the release of an auxochromic group in a chromophoric system, for example by hydrolysis. Dye precursors corresponding to this definition may be leuco dyes, couplers or even dyes which are converted into other dyes during processing. Providing no real significance is attached to a distinction between dye residues and the residues of dye precursors, dye precursor residues should also be regarded as dye residues in the following.

Suitable dye donors are described, for example, in U.S. Pat. Nos. 3,227,550, 3,443,939, 3,443,940, DE-A-Nos. 19 30 215, 22 42 762, 24 02 900, 24 06 664, 25 05 248, 25 43 902, 26 13 005, 26 45 656, 28 09 716, 28 23 159, BE-A- No. 861 241, EP-A- Nos. 0 004 399, 0 004 400, DE-A- Nos. 30 08 588, 30 14 669, GB-A- No. 80 12 242.

In some embodiments of the invention, the dye releasers may be present as oxidizable or couplable dye releasers, in others as reducible dye releasers. Depending on whether the dye is released from the oxidized form or from the reduced form of the dye releasers, a negative or positive copy of the original is obtained where standard, negatively working silver halide emulsions are used. Accordingly, positive or negative images can be obtained as required by selecting suitable dye releaser systems.

Oxidizable dye donors which are particularly suitable for the heat-developable recording materials according to the invention are described, for example, in DE-A-No. 26 45 656. The following are examples of those oxidizable dye releasers:

Dye releaser 1

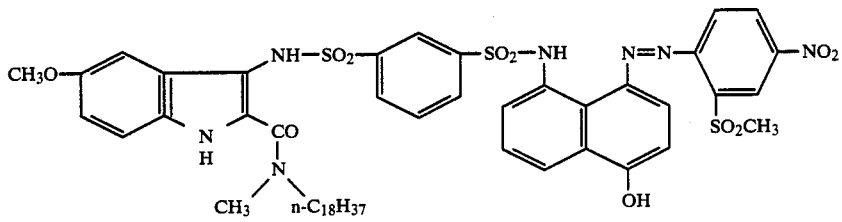

-continued

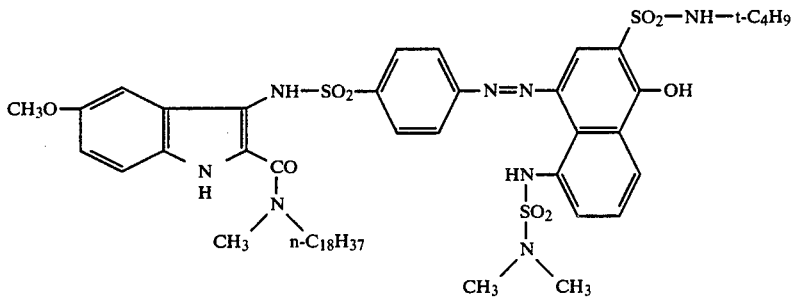

Dye releaser 2

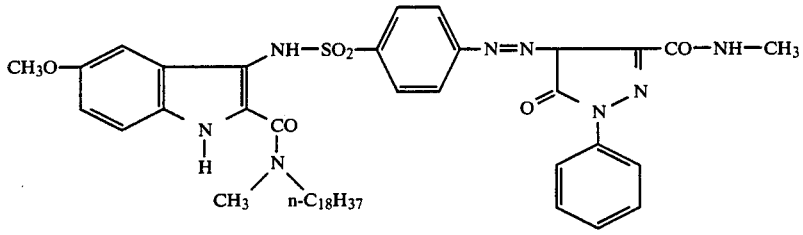

Dye releaser 3

Other equally suitable oxidizable dye releasers are described, for example, in DE-A-Nos. 22 42 762, 25 05 248, 26 13 005 and GB-A-No. 80 12 242.

If the dye releaser is oxidizable, it does itself represent a reducing agent which is oxidized either directly or indirectly with the aid of electron transfer agents (ETA) by the silver halide exposed imagewise or by the substantially non-photosensitive silver salt under the catalytic effect of the silver halide exposed imagewise. There arises here an imagewise differentiation in regard to the ability to release the diffusible dye. If, on the other hand, the dye releaser is reducible, it is best used in combination with a reducing agent present in a limited quantity (a so-called electron donor compound or electron donor precursor compound) which, in this case is contained in the same binder layer as the dye releaser, the photosensitive silver halide and, optionally, the substantially non-photosensitive silver salt. Even where reducible dye donors are used in combination with electron donor compounds, it can be of advantage to use electron transfer agents.

Where negatively working silver halide emulsions are used, positive color images of positive originals may be produced, for example, using a recording material according to the invention which contains reducible dye releasers corresponding to the following formula:

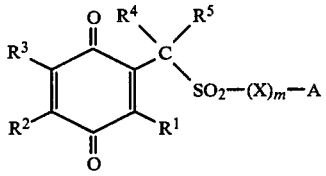

II in which $R^1$ is alkyl or aryl;

$R^2$ is alkyl, aryl or a group which, together with $R^3$, completes a fused ring;

$R^3$ represents hydrogen, alkyl, aryl, hydroxyl, halogen, such as chlorine or bromine, amino, alkylamino, dialkylamino, including cyclic amino groups (such as piperidino, morpholino), acylamino, alkylthio, alkoxy, aroxy, sulfo or a group which, together with $R^2$, completes a fused ring;

$R^4$ is alkyl;

$R^5$ is alkyl or, preferably, hydrogen;

A is the residue of a diffusible dye or dye precursor;

X is a divalent bond of the formula $—R—(L)_p—(R-)_q—$, where R is a $C_1$-$C_6$ alkylene group or an optionally substituted arylene or aralkyl group, the two groups R being the same as or different from one another;

L represents —O—, —CO—, $CONR^6$—, $—SO_2N-R^6$—, —O—CO—$NR^6$, —S—, —SO— or $—SO_2$— ($R^6$=hydrogen or alkyl);

p=0 or 1;

q=0 or 1;

m=0 or 1, at least one of the groups $R^1$, $R^2$, $R^3$ and $R^4$ containing a ballast group.

The alkyl groups represented by $R^1$, $R^2$, $R^3$ and $R^5$ in formula II may be linear or branched and generally contain up to 18 carbon atoms. Examples are methyl, n-propyl, tert.-butyl, tetradecyl, octadecyl. The aryl groups represented by $R^1$, $R^2$ and $R^3$ are, for example, phenyl groups which may be substituted, for example by long-chain alkoxy groups.

In an acylamino group represented by $R^3$, the acyl group is derived from aliphatic or aromatic carboxylic or sulfonic acids. The fused rings completed by $R^2$ and $R^3$ are preferably carbocyclic rings, for example fused benzene or bicyclo-[2,2,1]-heptene rings.

An alkyl group represented by $R^4$ may be linear or branched, substituted or unsubstituted and may contain up to 21 carbon atoms. Examples are methyl, nitromethyl, phenylmethyl (benzyl), heptyl, tridecyl; pentadecyl, heptadecyl, $—C_{21}H_{43}$.

Preferred embodiments of the dye donors used in accordance with the invention are those in which $R^1$, $R^2$ and $R^3$ in a quinoid carrier group together contain no more than 8 and, in particular, no more than 5 carbon atoms and $R^4$ is an alkyl group containing at least 11 carbon atoms.

Other preferred embodiments are those in which $R^1$ is an alkoxyphenyl group containing at least 12 carbon atoms in the alkoxy group and $R^2$, $R^3$ and $R^4$ together contain no more than 8 carbon atoms.

These dye releasers contain—attached to the dye residue—a diffusion-preventing releasable quinoid carrier group corresponding to the following formula

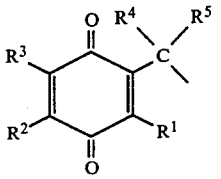

"carquin"

in which $R^1$, $R^2$, $R^3$, $R^4$ and $R^5$ have the same meaning as in formula II.

Reducible dye releasers of this type and others which are equally suitable for the heat-developable recording material according to the invention are described, for example, in DE-A-No. 28 09 716, EP-A-No. 0 004 399, DE-A-No. 30 08 588 and DE-A-No. 30 14 669. The following are examples of those dye donors:

Dye releaser 4

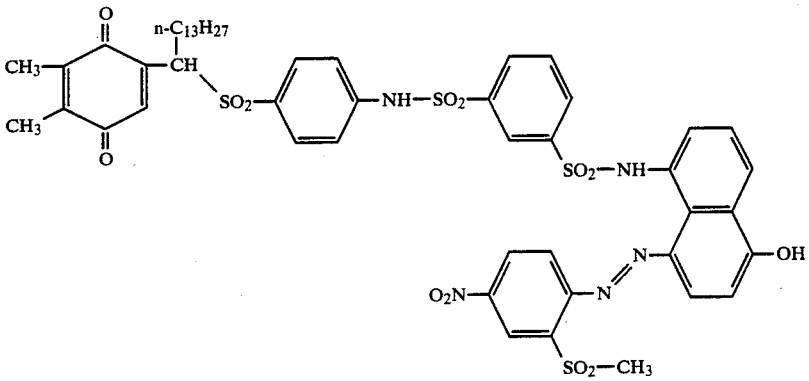

Dye releaser 5

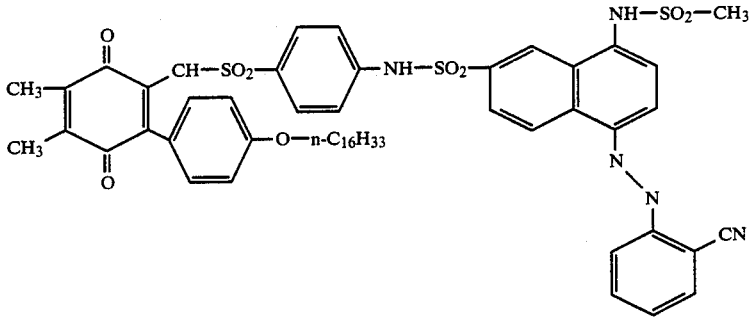

Dye releaser 6

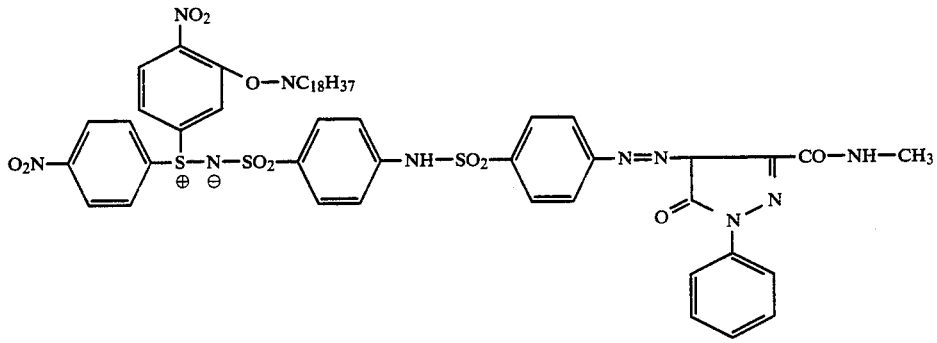

Where reducible dye releasers of the type in question are used (in combination with electron donor compounds), the fog-reducing compounds according to the invention produce a distinct increase in the maximal color density without at the same time increasing the fog level, because the developability of the emulsion is only slightly inhibited, if at all. In addition, where negative emulsions are used, the fog-reducing compounds according to the invention provide for a distinct increase in sensitivity compared with the use of the corresponding mercapto compounds according to DE-A-No. 33 45 023.

The electron donor compound used in combination with a reducible dye releaser also serves as a reducing agent for the silver halide, the substantially non-photosensitive silver salt and the dye releaser. By virtue of the fact that the substantially non-photosensitive silver salt and the dye donor as it were compete with one another during the oxidation of the electron donor compound, although the former is always superior to the latter in the presence of exposed silver halide, the silver halide present—after imagewise exposure—determines those regions of the image in which the dye releaser is converted into its reduced form by the electron donor compound. Under the development conditions, in the present case on heating of the color photographic recording material exposed imagewise, the electron donor compound present in a limited quantity is oxidized commensurate with the degree of exposure by the substantially non-photosensitive silver salt and the photosensitive silver halide under the catalytic effect of the latent image nuclei produced by exposure in the silver halide and, accordingly, is no longer available for a reaction with the dye releaser. This results so to speak in an imagewise distribution of unused electron donor compound.

The reaction between the electron donor compound and the dye releaser which is necessary for the release of the diffusible dyes can of course only take place where the electron donor compound has not already been consumed by other reactions, for example in the present case by the imagewise oxidation by the substantially non-photosensitive silver salt. Accordingly, an important prerequisite for the image-forming mechanism in this embodiment of the invention is a suitably graduated reactivity of those components which, potentially, would be involved in a reaction with the reducing agent present in the layer, namely the electron donor compound. The components in question are 1. the substantially non-photosensitive silver salt or silver halide in the absence of latent image nuclei,
2. the substantially non-photosensitive silver salt of silver halide in the presence of latent image nuclei,
3. the dye releaser.

It is a considerable advantage that, under the heat development conditions, the components mentioned show the desired graduated reactivity in regard to the reaction with the electron donor compound and that the reducing power of the latter is gauged in such a way that, in the absence of latent image nuclei, it does not significantly reduce the substantially non-photosensitive silver salt whereas, in the presence of latent image nuclei, it reduces the substantially non-photosensitive silver salt comparatively quickly and that it reduces the dye donor comparatively slowly, but more quickly than the substantially non-photosensitive metal salt (in the absence of latent image nuclei).

Examples of electron donor compounds which have already been described are non-diffusing or only slightly diffusing derivatives of hydroquinone, benzisoxazolone, p-aminophenol or ascorbic acid, for example ascorbyl palmitate (DE-A-No. 28 09 716).

Further examples of electron donor compounds are known from DE-A-Nos. 29 47 425, 30 06 268, 31 30 842, 31 44 037, 32 17 877 and EP-A-No. 0 124 915. It has been found that the electron donor compounds mentioned satisfy the demands made of them, even under heat development conditions, and accordingly are also suitable as electron donor compounds for the recording material according to the invention. Particularly suitable electron donor compounds are those which are only formed in the layer from corresponding electron donor precursor compounds under the heat development conditions, i.e. electron donor compounds which, before development, are only present in the recording material in a masked form in which they are virtually ineffective. Under the heat development conditions, the initially ineffective electron donor compounds are then converted into their active form, for example through the elimination of certain protective groups by hydrolysis. In the context of the invention, therefore, the electron donor precursor compounds mentioned are also understood to be electron donors.

The essential constituents of the recording material according to the invention as mentioned above, namely the photosensitive silver halide, the substantially non-photosensitive reducible silver salt optionally present and the dye releaser, optionally in combination with an electron donor compound, and also the fog-reducing compound used in accordance with the invention are present alongside one another dispersed in a binder. The binder in question may be either a hydrophobic or hydrophilic binder, hydrophilic binders being preferred. Gelatin is preferably used as binder for the photosensitive layer. However, it may be completely or partly replaced by natural or synthetic binders. Examples of natural binders are alginic acid and derivatives thereof, such as salts, esters or amides, cellulose derivatives, such as carboxymethylcellulose, alkylcelluloses, such as hydroxyethylcellulose, starch and derivatives thereof and also carrageenates. Examples of synthetic binders are polyvinylalcohol, partially hydrolyzed polyvinylacetate and polyvinylpyrrolidone.

Examples of hydrophobic binders are polymers of polymerizable, ethylenically unsaturated monomers, such as alkylacrylates, alkylmethacrylates, styrene, vinylchloride, vinylacetate, acrylonitrile and acrylamides. Polymers such as these may be used, for example, in latex form.

For producing monochromic color images, the photosensitive binder layer contains in association with the photosensitive silver halide and, optionally, the non-photosensitive silver salt one or more dye donors from which dyes of a certain color are released. The color ultimately obtained may be formed by mixing several dyes. In this way, it is also possible to produce black-and-white images by carefully coordinated mixing of several dye donors of different color. For producing multicolor color images, the photographic recording material according to the invention contains several, i.e. generally three, associations of dye releaser and differently spectrally sensitized silver halide, the absorption range of the dye released from the dye releaser preferably substantially coinciding with the spectral sensitivity range of the associated silver halide. The various associations of dye releaser and associated silver halide may be accommodated in various binder layers of the color photographic recording material, these various binder layers being separated by separation layers of a water-permeable binder, for example gelatin, of which the essential function is to separate the various associations from one another and thus to counteract color falsification. In such a case, the color photographic recording material according to the invention contains, for example, a photosensitive binder layer in which the silver halide present is predominantly red-sensitive through spectral sensitization, another photosensitive binder layer, in which the silver halide present is substantially green-sensitive through spectral sensitization, and a third photosensitive binder layer, in which the silver halide present is predominantly blue-sensitive either by virtue of its natural sensitivity or through spectral sensitization. The electron donor compounds optionally present in the three photosensitive layers may be the same or different. The same also applies to the substantially non-photosensitive silver salt optionally present in the three photosensitive binder layers and to the fog-reducing compound used in accordance with the invention.

In one preferred embodiment of the invention, each of the above-mentioned associations of photosensitive silver halide, substantially non-photosensitive silver salt (where present, and dye donor is used in the form of a so-called complex coacervate.

A complex coacervate is understood to be a form of dispersion in which a mixture of the essential constituents is accommodated in a common shell of a hardened binder. Dispersions such as these are also known as packet emulsions and are obtained by complex coacervation.

Complex coacervation is understood to be the occurrence of two phases during the mixing of an aqueous solution of a polycationic colloid and an aqueous solution of a polyanionic colloid, a concentrated colloid phase (hereinafter referred to as complex coacervate) and a dilute colloid phase (hereinafter referred to as equilibrium solution) being formed in consequence of an electrical interaction. The complex coacervate is separated from the equilibrium solution in the form of droplets and appears as white-colored clouding. If the complex coacervation is carried out in the presence of a solid, such as silver halide, or fine oil droplets, it is generally assumed that the complex coacervate surrounds the solid or the droplets in the interior of colloid particles. This results in the formation of a dispersion of coacervate particles in which the solid (in the present case the photosensitive silver halide and, optionally, the substantially non-photosensitive silver salt) and oily droplets of a solution of the organic constituents (in the present case the dye donor and, optionally, other auxiliaries) are incorporated. The particles are then hardened with a hardener so that they do not lose their original form in the following stages of the production of the photographic recording material, such as preparation of the casting solution and coating. The dispersion is best cooled before hardening to a temperature of 25° C. or lower, preferably to a temperature of 10° C. or lower, so that a high-quality packet emulsion is obtained.

One method of producing a packet emulsion, in which a color-providing compound is incorporated by complex coacervation, is described for example in U.S. Pat. Nos. 3,276,869 and in 3,396,026.

The hydrophilic colloids, which may be used for complex coacervation, may be divided into two groups. The first group comprises compounds containing a nitrogen atom; an aqueous solution thereof shows a negative charge at a pH value which is higher than its isoelectric point and a positive charge at a pH value which is lower than its isoelectric point (i.e. a cationic compound or polymer). Examples of these compounds include gelatin, casein, albumin, haemoglobin, polyvinylpyrrolidone. A second group comprises compounds of which an aqueous solution always shows a negative charge irrespective of the pH value (i.e. an anionic compound). Examples of these compounds include a natural colloid, such as sodium alginate, gum arabic, agar agar, pectin, a synthetic polymer containing an acidic group or an alkali salt thereof, such as a copolymer of vinylmethylether or ethylene and maleic acid anhydride, carboxymethylcellulose, polyvinylsulfonic acid, a condensation product of naphthalene sulfonic acid and formalin or a gelatin derivative in which a part which would be suitable for carrying a positive charge is blocked by esterification. Preferred examples of anionic polymers which may be used in accordance with the invention comprise compounds with recurring units which contain carboxylate and/or sulfonate groups and which have a molecular weight of no less than 1000 and preferably of no less than 3000. Of the compounds belonging to these two groups, gelatin, agar agar and sodium alginate may be gelatinized by cooling. Gelatin is particularly suitable for the preparation of the packet emulsion, because it gelatinizes by cooling and may readily be hardened with a hardener.

A combination of gelatin and an anionic polymer is preferably used for carrying out the complex coacervation. The quantity of colloidal substances used varies according to the charge density of the substances at the time of coacervation. However, the colloid of one group is generally used in a quantity of from 1/20th to 20 times the quantity by weight of the colloid of the other group. It is preferred to use a ratio by weight of from 0.5:1 to 4:1 in a combination of gelatin and gum arabic and a ratio by weight of from 10:1 to 40:1 in a combination of gelatin and a condensation product of naphthalene sulfonic acid and formalin.

The following four conditions have to be satisfied to obtain complex coacervation:

First, the concentration of the hydrophilic colloid both in the first group and also in the second group must be between 0.5 and 6% and preferably between 1 and 4%.

Secondly, the pH-value must not be above 5.5. The size of the packet emulsion particles varies largely in dependence upon the pH-value, but also basically upon the degree of mixing. The optimal pH-value varies according to the type of colloid used, but in most cases is in the range from 5.2 to 4.0 and preferably in the range from 5.0 to 4.5. The size of the packet emulsion particles used is usually in the range of from 1 to 100 μm, preferably in the range of from 2 to 60 μm and more preferably in the range of from 5 to 10 μm.

Thirdly, the temperature of the system must be higher than the solidification temperature of the aqueous colloid solution. In the case of gelatin, the temperature should not be below 35° C. and is preferably in the range of from 40° to 55° C.

Fourthly, the quantity of coexisting inorganic salt must not exceed a certain critical value which is characteristic of the nature of the salt.

The preparation of the packet emulsion by complex coacervation is generally carried out by one of the following two methods.

In the first method, hydrophilic colloids which are selected from the first group and from the second group are mixed in a suitable ratio and an aqueous solution thereof is prepared in a concentration of from 1 to 4% by weight. The temperature of the solution is kept in the range of from 35° to 60° C. whilst the pH-value is kept above 5.5. The pH-value is reduced by addition of an acid in order to effect coacervation.

In the second method, a temperature (no lower than 35° C.) and a pH-value (no more than 5.5) are maintained under conditions under which coacervation can take place and an aqueous hydrophilic colloid solution having a concentration of, initially, at least 6% by weight is diluted by addition of warm water until the concentration suitable for coacervation is reached.

However, if a packet emulsion is prepared by the first or second method or by both, the quantity of packet emulsion is very small by comparison with the volume of the diluted continuous phase of the hydrophilic colloid. Accordingly, a large quantity of binder, for example gelatin, has to be subsequently added so that the emulsion may be directly used for coating. Various methods may be used for concentrating and drying the packet emulsion. In one known method, the dilute colloid solution containing a packet emulsion in dispersed form is filtered. In another method, the colloid solution is left standing to precipitate the packet emulsion. The supernatant liquid is then removed by decantation. A centrifugal separator may be used to accelerate precipitation. In addition, for the complete removal of water, the packet emulsion may be atomized by spray drying methods of the type known, for example, for the production of microcapsules.

Examples of hardeners which may be used for the preparation of the packet emulsion according to the invention are chromium salts (for example chrome alum, chromium acetate), aldehydes (for example formaldehyde, glyoxal, glutaraldehyde), N-methylol compounds (for example dimethylol urea, methylol dimethylhydantoin), dioxane derivatives (for example 2,3-dihydroxydioxane), active vinyl compounds (for example 1,3,5-triacryloyl hexahydro-s-triazine, 1,3-vinylsulfonyl-2-propanol), active halogen compounds (for example 2,4-dichloro-6-hydroxy-s-triazine) and mucohalic acids (for example mucochloric acid, mucophenoxychloric acid). The hardeners may be used either individually or in admixture.

According to the invention, the use of packet emulsions enables several emulsion fractions of different spectral sensitivity, including the corresponding dye donors, to be combined in a single binder layer without losing the spectral association so that no color falsification occurs. This is possible because the extent to which a certain silver halide particle is exposed almost exclusively determines the degree of dye release from the dye donor contained in the same coacervate particle (packet) as the silver halide. Accordingly, the use of packet emulsions enables a blue-sensitive, a green-sensitive and a red-sensitive silver halide emulsion with substantially non-photosensitive silver salt additionally present, if any, and spectrally associated releasers to be accomodated in the same binder layer without any danger of serious color falsification.

In addition to the constituents already mentioned, the color photographic recording material according to the invention may contain other constituents and auxiliaries which, for example, promote the heat treatment and the accompanying dye transfer. These other constituents and auxiliaries may be accommodated in a photosensitive layer or in a non-sensitive layer.

Auxiliaries of the type in question are, for example, auxiliary developers. These auxiliary developers generally have developing properties for exposed silver halide. In the present case, they have above all a promoting effect on the reactions taking place between the exposed silver salt (=silver salt in the presence of exposed silver halide) and the reducing agent (where oxidizable dye donors are used, the reducing agent is identical therewith; where reducible dye donors are used, the reducing agent in turn reacts with the dye donor). Since this reaction consists predominantly in a transfer of electrons, the auxiliary developers are also known as electron transfer agents (ETA).

Examples of suitable auxiliary developers are hydroquinone, pyrocatechol, pyrogallol, hydroxylamine, ascorbic acid, 1-phenyl-3-pyrazolinone and derivatives thereof. Since the auxiliary developers perform virtually a catalytic function, there is no need for them to be present in stoichiometric quantities. In general, it is sufficient if they are present in the layer in quantities of up to ½ mole per mole of dye releaser. They may be incorporated in the layer, for example, from solutions in water-soluble solvents or in the form of aqueous dispersions obtained using oil formers.

Other auxiliaries are, for example, basic substances or compounds which are capable of making basic compounds available under the effect of the heat treatment. Suitable auxiliaries of this type are, for example, sodium hydroxide, potassium hydroxide, calcium hydroxide, sodium carbonate, sodium acetate and organic bases, particularly amines, such as trialkylamines, hydroxyalkylamines, piperidine, morpholine, dialkylaniline, p-toluidine, 2-picoline, guanidine and salts thereof, particularly salts with aliphatic carboxylic acids. By making the basic substances available, a medium is created during the heat treatment in the photosensitive layer and the adjoining layers which is suitable for guaranteeing the release of the diffusible dyes from the dye releasers and their diffusion into the image-receiving layer.

Other auxiliaries are, for example, compounds which are capable of releasing water under the effect of heat. Compounds such as these are, in particular, inorganic salts containing water of crystallization, for example $Na_2SO_4.10H_2O$ and $NH_4Fe(SO_4)_2.12H_2O$. The water released during heating promotes the development and diffusion processes required for image production.

Examples of other auxiliaries are the so-called thermal solvents which are generally understood to be non-hydrolyzable organic compounds which are solid under normal conditions, but which melt on heating to the heat-treatment temperature and, in doing so, provide a liquid medium in which the development processes can take place more quickly. Thermal solvents such as these may act for example as diffusion accelerators. Preferred examples of the thermal solvents are polyglycols of the type described, for example, in U.S. Pat. No. 3,347,675, for example polyethylene glycol having an average molecular weight of from 1500 to 20,000, derivatives of polyethylene oxide, such as for example oleic acid esters thereof, beeswax, monostearol, compounds having a high dielectric constant and containing an —$SO_2$— or —CO— group, such as for example acetamide, succinamide, ethylcarbamate, urea, methylsulfonamide, ethylene carbonate, also polar substances of the type described in U.S. Pat. No. 3,667,959, the lactone of 4-hydroxybutanoic acid or 4-hydroxybutyric acid, dimethylsulfoxide, tetrahydrothiophene-1,1-dioxide and 1,10-decane diol, methylanisate, biphenylsuberate, etc., as described in Research Disclosure, pages 26 to 28 (December 1976), etc.

The development of the color photographic recording material according to the invention exposed imagewise is initiated by subjecting it to a heat treatment in which the photosensitive binder layer is heated for about 0.5 to 300 s to an elevated temperature of, for example, from 80° to 250° C. This establishes in the recording material conditions suitable for the development processes, including dye diffusion, without any need to supply a liquid medium, for example in the form of a developer bath. During development, diffusible dyes are released imagewise from the dye releasers and transferred to an image-receiving layer which is either an integral part of the color photographic recording material according to the invention or which is in contact therewith at least during the development time.

Imagewise silver development, dye release and dye transfer take place synchronously in a one-step development process.

In addition, the production of color images using the color photographic recording material according to the invention may also be carried out in a two-step development process where development of the silver halide and dye release take place in a first step and the dye image is transferred from the photosensitive part to an image-receiving part in contact therewith in a second step, for example by heating to a temperature of from 50° to 150° C. and preferably to a temperature of from 70° to 90° C. In this case, diffusion aids (solvents) may be externally applied before lamination of the photosensitive part and the image-receiving part.

Accordingly, the image-receiving layer may be arranged on the same layer support as the photosensitive element (one-sheet material) or on a separate layer support (two-sheet material). It consists essentially of a binder, the mordant for fixing the diffusible dyes released from the non-diffusing dye releasers. Preferred mordants for anionic dyes are long-chain quaternary ammonium or phosphonium compounds, for example those described in U.S. Pat. Nos. 3,271,147 and 3,271,148.

In addition, it is also possible to use certain metal salts and hydroxides thereof which form sparingly soluble compounds with the acidic dyes. Polymeric mordants, for example those described in DE-A-Nos. 23 15 304, in 26 31 521 or in 29 41 818, may also be used. The dye mordants are dispersed in one of the usual hydrophilic binders in the mordant layer, for example in gelatin, polyvinylpyrrolidone, completely or partially hydrolyzed cellulose esters. Some binders may of course also function as mordants, for example polymers of nitrogen-containing, optionally quaternary bases, such as N-methyl-4-vinylpyridine, 4-vinylpyridine, 1-vinylimidazole, as described for example in U.S. Pat. No. 2,484,430. Other suitable mordant binders are, for example, guanyl hydrazone derivatives of alkylvinylketone polymers, as described for example in U.S. Pat. No. 2,882,156, or guanyl hydrazone derivatives of acylstyrene polymers of the type described, for example, in DE-A-No. 20 09 498. However, other binders, for example gelatin, will generally be added to the mordant binders just mentioned.

If, on completion of development, the image-receiving layer remains in layer contact with the photosensitive element, an alkali-permeable pigment-containing light-reflecting binder layer is generally present between them, optically separating negative and positive and serving as an aesthetically pleasing image background for the positive dye image transferred.

If the image-receiving layer is arranged between the layer support and the photosensitive element and is separated from the photosensitive element by a preformed light reflecting layer, either the layer support must be transparent, so that the dye transfer image produced can be viewed through it, or the photosensitive element must be removed together with the light-reflecting layer from the image-receiving layer in order to expose the image-receiving layer. However, the image-receiving layer may also be present as the uppermost layer in an integral color photographic recording material, in which case exposure is best effected through the transparent layer support.

EXAMPLE 1

Preparation of the silver salt emulsion

Emulsion 1

17.0 g of $AgNO_3$ dissolved in 200 ml of water heated to 45° C. were added over a period of 2 minutes with stirring to a solution heated to 45° C. of 2.0 g of gelatin in 1000 ml of water containing 13.0 g of benzotriazole (BTA). After stirring for 5 minutes, a pH of 5.0 was adjusted with 5% $Na_2CO_3$ solution. By adding 20 ml of a 10% polystyrene sulfonic acid solution, cooling to 25° C. and adding 10% sulfuric acid (pH 3.0 to 3.5), a flocculate was formed and washed three times with 1000 ml of water. The flocculate was then heated to 45° C., adjusted to pH 6.0 with 5% $Na_2CO_3$ solution and, after the addition of 5 ml of a 1% aqueous phenol solution, was adjusted to a final weight of 435 g by the addition of water.

Emulsion 2

34.0 g of $AgNO_3$ dissolved in 200 ml of water were added over a period of 10 minutes to a solution heated to 50° C. of 40.0 g of gelatin, 23.7 g of KBr and 1.66 g of KI. After stirring for 20 minutes at 50° C., followed by cooling to 35° C., 40 ml of a 10% polystyrene sulfonic acid solution were added dropwise. After cooling, a flocculate was formed by the addition of 10% sulfuric acid (to pH 3.0–3.5) and washed three times with 700 ml of water. The flocculate was then heated to 40° C. and adjusted to pH 6.0 with 10% sodium hydroxide solution. Final weight 1171 g.

EXAMPLE 2

Preparation of the dispersates

Dispersate 1 (dye releaser cyan)

36.4 g of dye releaser 1 (cyan) were dissolved in 82.1 g of diethyllaurylamide and the resulting solution dispersed in 1090 g of 6% aqueous gelatin solution in the presence of 2.6 g of sodium dodecylbenzene sulfonate.

Dispersate 2 (dye releaser magenta)

41.8 g of dye releaser 2 (magenta) were dissolved in 90.0 g of diethyllaurylamide and the resulting solution dispersed in 906 g of 6% aqueous gelatin solution in the presence of 2.9 g of sodium dodecylbenzene sulfonate.

Dispersate 3 (dye releaser yellow)

54.8 g of dye releaser 3 (yellow) were dissolved in 90.0 g of diethyllaurylamide and the resulting solution dispersed in 957 g of 6% aqueous gelatin solution in the presence of 2.8 g of sodium dodecylbenzene sulfonate.

EXAMPLE 3

Photosensitive recording materials for the heat development process (materials 1 to 9) were prepared by coating a transparent layer support of polyethylene terephthalate with various casting solutions which had been prepared as follows:

Material 1 (cyan)

| | | |
|---|---|---|
| (a) | 32.0 g | emulsion 2 (Example 1), sensitized by addition of a 0.1% methanolic solution of a red sensitizer in a quantity of $4 \times 10^{-4}$ mole/mole silver halide |
| (b) | 42.0 g | emulsion 1 (Example 1) |
| (c) | 28.4 g | dispersate 1 (Example 2) |

-continued

| | | |
|---|---|---|
| (d) | 8.0 ml | of a 4% solution of a wetting agent |
| (e) | 70.0 g | of a 20% aqueous gelatin solution |
| (f) | 3.0 g | guanidine trichloroacetate dissolved in 30 ml of water |
| (g) | 0.3 g | of auxiliary developer dissolved in 10 ml of methanol/water (1:1) |
| (h) | 109 ml | water. |

Material 2 (magenta)

As material 1, but with the following changes:

| | | |
|---|---|---|
| (a) | 32.0 g | emulsion 2 sensitized by addition of a 0.1% methanoic solution of a green sensitizer in a quantity of $4 \times 10^{-4}$ mole/mole silver halide |
| (c) | 24.0 g | dispersate 2 (Example 2) |
| (h) | 112 ml | water |

Material 3 (yellow)

As material 1, but with the following changes:

| | | |
|---|---|---|
| (a) | 32.0 g | emulsion 2 sensitized by addition of a 0.1% methanolic solution of a blue sensitizer in a quantity of $4 \times 10^{-4}$ mole/mole silver halide |
| (c) | 26.0 g | dispersate 3 (Example 2). |

Material 4 (cyan)

As material 1, but additionally containing 0.55 g of compound 31

Material 5 (magenta)

As material 2, but additionally containing 0.55 g of compound 31

Material 6 (yellow)

As material 3, but additionally containing 0.55 g of compound 31

Material 7 (cyan)

As material 1, but additionally containing 0.38 g of comparison compound A

Material 8 (magenta)

As material 2, but additionally containing 0.38 g of comparison compound A

Material 9 (yellow)

As material 3, but additionally containing 0.38 g of comparison compound A.

In every case, the wet layer thickness was 100 μm. The materials were hardened by overcoating with a hardening layer.

The following additives were used:

Red sensitizer:

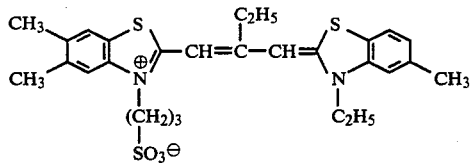

Green sensitizer:

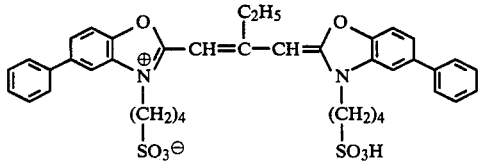

-continued

Blue sensitizer:

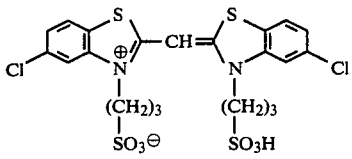

Wetting agent:

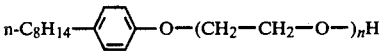

Triton X 100 n = 9 to 10
(a product of Rohm & Haas)

Auxiliary developer:

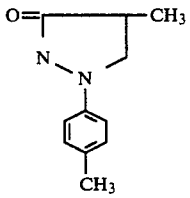

Comparison compound A

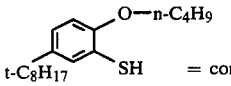

= compound 43 from DE-A-33 45 023

The materials may be used as a negative sheet in combination with a suitable image-receiving sheet (two-sheet process) or may serve as a coating support providing they are overcoated with an image receiving element to form an integral recording material (one-sheet).

EXAMPLE 4

The image-receiving part of a photographic recording material for the dye diffusion transfer process was prepared by successively applying the following layers to a transparent layer support of polyethylene terephthalate. The quantities indicated represent quantities per square meter.

1. A mordant layer containing 2 g of polyurethane mordant of 4,4'-diphenylmethane diisocyanate and N-ethyldiethanolamine, quaternized with epichlorohydrin in accordance with DE-A No. 26 31 521, Example 1, and 2 g of gelatin.
2. A light-reflecting layer containing 10 g of $TiO_2$ and 1 g of gelatin.
3. A protective layer containing 1 g of gelatin.

EXAMPLE 5

Samples of materials 1 to 9 (Example 3) were exposed behind a gray wedge as shown in Table 1 (exposure time and light intensity), then uniformly heated for 60 s to 120° C. and, by means of a pair of rubber rollers, subsequently laminated on the layer side onto the image-receiving material of Example 4 which had been previously swollen with water for 30 seconds. The resulting laminate was heated for 60 s to 75° C. and then separated again. The Dmin and Dmax values of the transferred color wedges are shown in Table 1.

TABLE 1

| Material* | Stabilizer | Exposure s | Exposure lux | Dmax | Dmin |
|---|---|---|---|---|---|
| 1 C | — | 2 | 200 | 2.11 | 0.52 |
| 2 M | — | 2 | 200 | 2.01 | 0.85 |
| 3 Y | — | 2 | 200 | 1.95 | 0.33 |
| 4 C | compound 31 | 4 | 200 | 2.25 | 0.17 |
| 5 M | compound 31 | 4 | 200 | 2.09 | 0.15 |
| 6 Y | compound 31 | 4 | 200 | 1.98 | 0.11 |
| 7 C | compound A | 10 | 2000 | 2.12 | 0.16 |
| 8 M | compound A | 10 | 2000 | 2.01 | 0.19 |
| 9 Y | compound A | 10 | 2000 | 1.92 | 0.13 |
| 7 C | compound A | 4 | 200 | 0.35 | 0.07 |
| 8 M | compound A | 4 | 200 | 0.31 | 0.07 |
| 9 Y | compound A | 4 | 200 | 0.27 | 0.05 |

*C = cyan, M = magenta, Y = yellow

It can be seen from Table 1 that the fog-reducing compound according to the invention (compound 31) brings about a drastic increase in sensitivity (materials 4, 5 and 6) compared with compound A according to DE-A-No. 33 45 023 (materials 7, 8 and 9) used for comparison. If materials 7, 8 and 9 are exposed in the same way as materials 4, 5 and 6 (4 s; 200 lux), inadequate Dmax values are obtained. Although materials 1, 2 and 3, which do not contain a fog-reducing compound, are comparable in sensitivity with materials 4, 5 and 6 according to the invention, they show excessively high fog levels.

Comparable results are obtained where a pure silver halide emulsion is used instead of the mixture of emulsions 1 and 2 as in Example 3.

We claim:

1. A color photographic recording material developable by heat treatment and comprising at least one binder layer which is applied to a layer support and which contains photosensitive silver halide, optionally a substantially non-photosensitive silver salt, at least one non-diffusing color-providing compound which is capable of releasing a diffusible dye in consequence of development by heat treatment and a fog-reducing compound, wherein the fog-reducing compound corresponds to the following formula $$R^1—S—CO—O—R^2 \qquad I$$

in which $R^1$ and $R^2$ may be the same or different and each represent an alkyl, alkenyl, cycloalkyl, aralkyl or aryl group.

2. A recording material as claimed in claim 1 wherein $R^1$ in formula I represents an aryl group substituted by halogen, alkyl, alkoxy, acylamino, alkoxycarbonyl and/or sulfamoyl.

3. A recording material as claimed in claim 1 or claim 2 wherein $R^2$ represents an alkyl, cycloalkyl or aryl group containing up to 10 carbon atoms.

4. A recording material as claimed in claim 1 wherein the fog-reducing compound of formula I is present in a quantity of from 0.01 to 0.5 mole per mole of silver salt.

5. A recording material as claimed in claim 1 wherein the color-providing compound is an oxidizable color-providing compound capable of releasing a diffusible dye as a result of oxidation.

6. A recording material as claimed in claim 1 wherein the color-providing compound is a reducible color-providing compound capable of releasing a diffusible dye as a result of reduction, and the reducible color-providing compound is used in combination with an electron donor compound.

7. A recording material as claimed in claim 1 containing three combinations of a photosensitive silver salt and a non-diffusing color-providing compound which is capable of releasing a diffusible dye, the silver halide in each of the three combinations having a different spectral sensitivity and the color-providing compound associated with the silver halide being capable of releasing a dye of which the absorption range substantially coincides with the spectral sensitivity range of the associated silver halide.

8. A recording material as claimed in claim 7 containing the three combinations in three binder layers arranged one above the other and optionally separated by separating layers.

9. A recording material as claimed in claim 7 containing the three combinations in the form of separate, complex coacervates in a common binder layer.

* * * * *